US006749546B2

(12) United States Patent
Yang

(10) Patent No.: US 6,749,546 B2
(45) Date of Patent: Jun. 15, 2004

(54) STRUCTURE OF AN EXERCISING APPARATUS AS A ROWBOAT

(76) Inventor: Lien-Chaun Yang, 11F-1, No. 149, Sec. 3, Roosevelt Rd., Taipei (TW)

( * ) Notice: Subject to any disclaimer, the term of this patent is extended or adjusted under 35 U.S.C. 154(b) by 102 days.

(21) Appl. No.: 10/231,040

(22) Filed: Aug. 30, 2002

(65) Prior Publication Data

US 2004/0043874 A1 Mar. 4, 2004

(51) Int. Cl.[7] ..... A63B 69/06; A63B 21/015; A63B 21/018; A63B 71/00

(52) U.S. Cl. ..... 482/72; 482/116; 482/120; 482/8

(58) Field of Search ..... 482/72, 8, 114–116, 482/120

(56) References Cited

U.S. PATENT DOCUMENTS 1,707,791 A * 4/1929 Anderson ..... 482/72
4,714,244 A * 12/1987 Kolomayets et al. ..... 482/72
4,822,032 A * 4/1989 Whitmore et al. ..... 482/63
4,840,372 A * 6/1989 Oglesby et al. ..... 482/9
5,108,090 A * 4/1992 Reed ..... 482/5
5,547,444 A * 8/1996 Huang ..... 482/72
6,090,017 A * 7/2000 Wang ..... 482/72
6,206,812 B1 * 3/2001 Nizamuddin ..... 482/131

FOREIGN PATENT DOCUMENTS

GB 2175813 A * 12/1986 ..... A63B/21/02

* cited by examiner

*Primary Examiner*—Nicholas D. Lucchesi
*Assistant Examiner*—Fenn C Mathew
(74) *Attorney, Agent, or Firm*—Troxell Law Office PLLC

(57) ABSTRACT

A structure of an exercising apparatus as a rowboat including mainly a housing and a base skeleton, the housing includes a handle, a drawing element, a pedaling portion, a display device, a sensor and a reeling axle. When the handle is drawn backwards to move, the drawing element is moved to leave the housing and to move the reeling axle, so that part of the drawing element having been reeled in is reeled off the reeling axle; when the drawing force is stopped, the reeling axle reels back automatically to reel back the drawing element to thereby restore the drawing element and the handle to their original positions. A user can pull the handle to and fro to simulate the action of rowing a boat. The functioning elements are received in the housing, the pedaling portion can be folded to be hidden in the bottoms of the two sides of the housing, the base skeleton can be extended and contracted, so that the effect of saving space after use and the effect of exercising can be obtained.

7 Claims, 6 Drawing Sheets

STRUCTURE OF AN EXERCISING APPARATUS AS A ROWBOAT

BACKGROUND OF THE INVENTION

1. Field of the Invention

The present invention is related to the structure of an exercising apparatus as a rowboat; and especially to such an apparatus of which the functioning elements can be received in a housing, the pedaling portion can be folded to be hidden in the bottoms of the two sides of the housing, the base skeleton can be extended and contracted for adjustment in relation to the housing to simulate the action of rowing a boat.

2. Description of the Prior Art

In gradual development of science and technology as well as changing of the society, people have been getting more and more busy, and their physical health has been neglected; population now is very large, people crowd at the sites for enjoying leisure in holidays, spaces for leisure and sports are getting less sufficient, increasing of health centers surely solves part of the problem of requiring sport sites. However, health centers can not be found anywhere, and the expenditure therein is too expensive to afford for ordinary people; to purchase required exercising apparatuses directly for use in homes can not only save moneys and time, but also allows people to exercise at any time. Among a lot of exercising apparatuses, treadmills and rowing machines are both welcome by users. The design of a rowing machine allows exercising of the muscles all around a human body including the muscles of hands, feet and back etc., and especially suits medical rehabilitation, unlike a treadmill that is probable to bring harm to joints of a person. In a conventional rowing machine, it is designed to be a fixed style, the functioning elements thereof are mostly exposed, such fixed style makes occupation of large fixed spaces, and renders using and storage of it inconvenient.

In view of this, the structure of the exercising apparatus as a rowboat of the present invention is developed; it has the effect of saving space and can be more effective in obtaining the object of exercising.

SUMMARY OF THE INVENTION

An object of the present invention is to provide the structure of an exercising apparatus as a rowboat which is designed according to the requirement of users as well as the different locations to allow the length of the whole base skeleton of the apparatus to be properly adjusted.

Another object of the present invention is to provide the structure of an exercising apparatus as a rowboat of which the functioning elements can be received in a housing, the pedaling portion can be folded to be hidden in the bottoms of the two sides of the housing, so that storing and moving of the apparatus can be more convenient.

Therefore, in order to achieve the above stated objects, the structure of the exercising apparatus as a rowboat of the present invention is comprised mainly of a housing and a base skeleton; the housing includes a handle, a drawing element, a pedaling portion, a display device, a sensor and a reeling axle; the base skeleton includes two supporting rods, a seat and two base skeleton stands. When the handle is drawn backwards to move, the drawing element is moved to leave the housing and to move the reeling axle, so that part of the drawing element having been reeled in is reeled off the reeling axle; when the drawing force is stopped, the reeling axle reels back automatically to reel back the drawing element to thereby restore the drawing element and the handle to their original positions. A user can pull the handle to and fro to simulate the action of rowing a boat. The functioning elements are received in the housing, the pedaling portion can be folded to be hidden in the bottoms of the two sides of the housing, the base skeleton can be extended and contracted, so that the effect of saving space after use and the effect of exercising can be obtained.

The present invention will be apparent in its features and structure after reading the detailed description of the preferred embodiment thereof in reference to the accompanying drawings.

DETAILED DESCRIPTION OF THE PREFERRED EMBODIMENT

Figure 1:
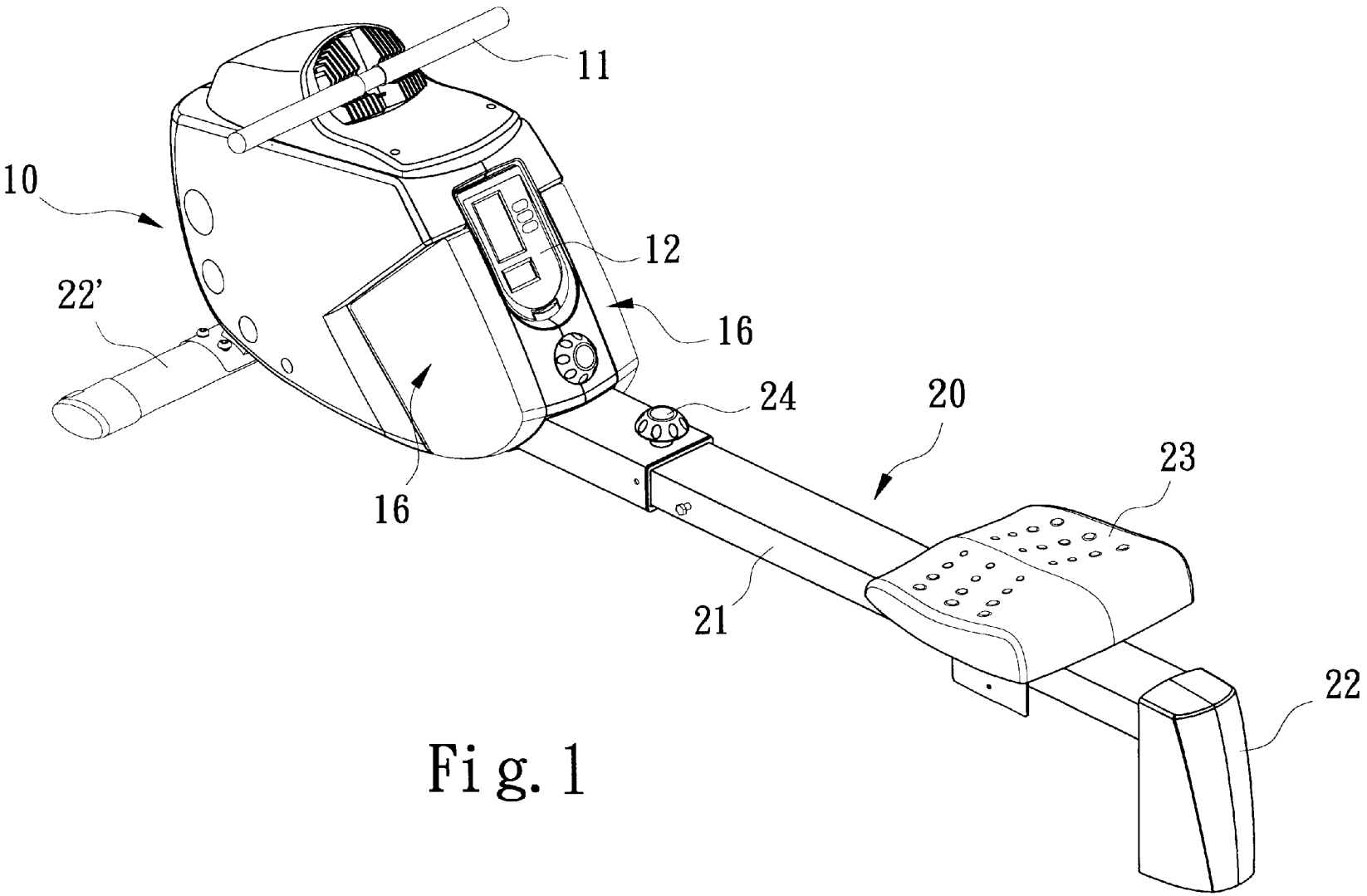
FIG. 1 is a perspective view of an embodiment of the exercising apparatus as a rowboat of the present invention.
Figure 2:
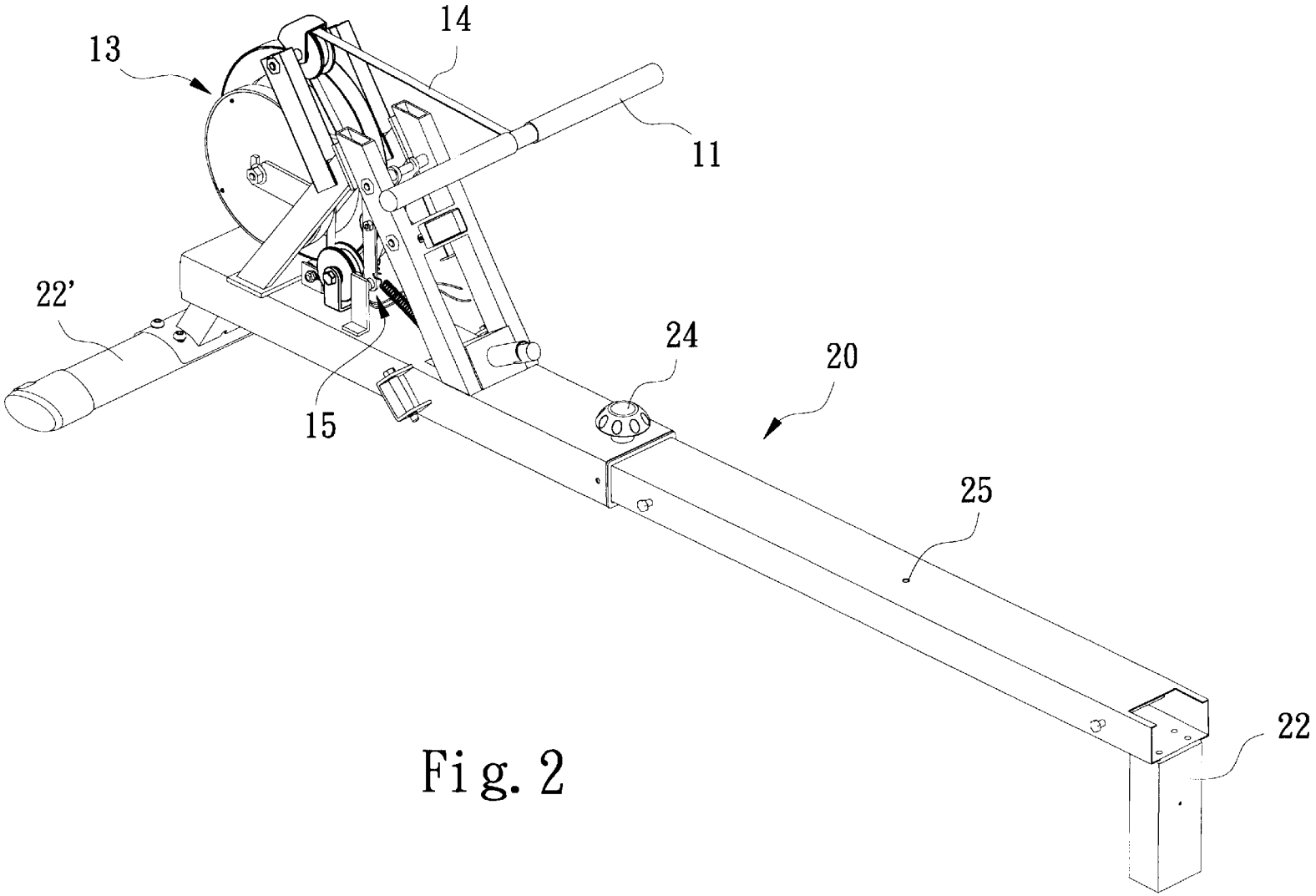
FIG. 2 is a perspective view showing the appearance of the present invention when taking off a housing and a seat thereof.

Referring firstly to FIGS. 1, 2 showing an embodiment of the exercising apparatus as a rowboat of the present invention, the apparatus is comprised mainly of a housing 10 and a base skeleton 20; the housing 10 is hollow and includes externally thereof a handle 11, two pedals 16, a display device 12, and includes internally thereof a reeling axle 13, a drawing element 14 and a sensor 15. The handle 11 and the reeling axle 13 link up with each other by means of the drawing element 14, and the numerals indicating the repeated pulling action of them on the sensor 15 in the housing 10 is transmitted to the display device 12 provided externally of the housing 10. The two pedals 16 of the pedaling portion are provided respectively on the two lateral sides of the housing 10 (referring to FIG. 3) and is comprised of a bottom plate 161, a fastening belt 162, a heel abutting plate 163, a side plate 164 and a connecting piece 165; wherein the heel abutting plate 163 is designed to be able to move up and down, the pedaling portion 16 and the housing 10 are connected with each other by means of the connecting piece 165 and can be unfolded in use and folded into the housing 10 after use (as shown in FIGS. 1, 3).

The base skeleton 20 is provided under the housing 10 (referring to FIG. 1), and is comprised of two mutually telescopically connected supporting rods 21, two base skeleton stands 22, 22' and a seat 23. The supporting rods 21 are provided thereon with a fixing member 24 and a plurality of fixing holes 25 for the purpose of fixing the length of the supporting rods 21 after being extended and contracted (as shown in FIG. 2). The base skeleton stands 22, 22' are fixed on the two ends of the supporting rods 21 to support the housing 10 and the supporting rods 21. The seat 23 can be designed to be movable between the fixing member 24 and the rear base skeleton stand 22 (referring to FIGS. 4*a*, 4*b*). By providing the above stated members, the exercising apparatus as a rowboat is completed.

Figure 3:
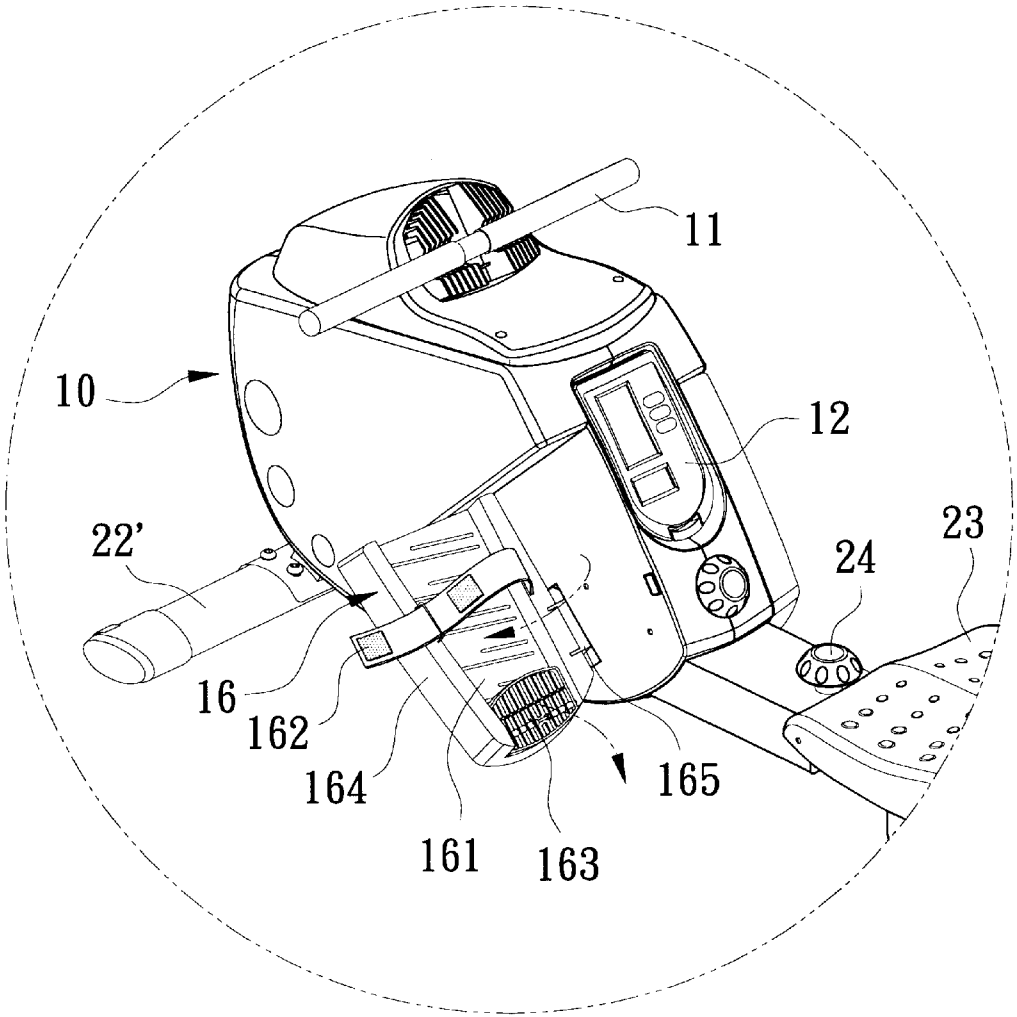
FIG. 3 is a perspective view showing a pedaling portion and the housing of the present invention.
Figure 4A:
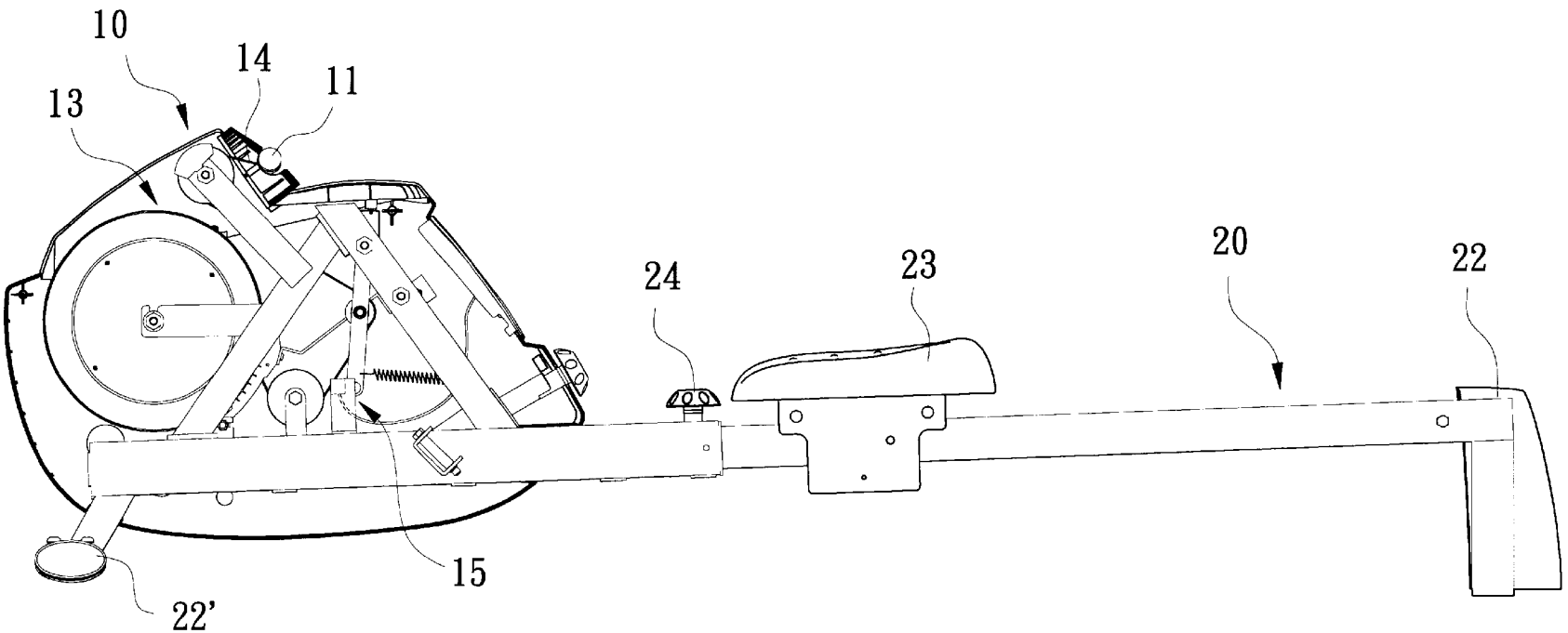
FIGS. 4*a*, 4*b* are schematic views showing the exercising apparatus as a rowboat of the present invention in use.
Figure 4B:
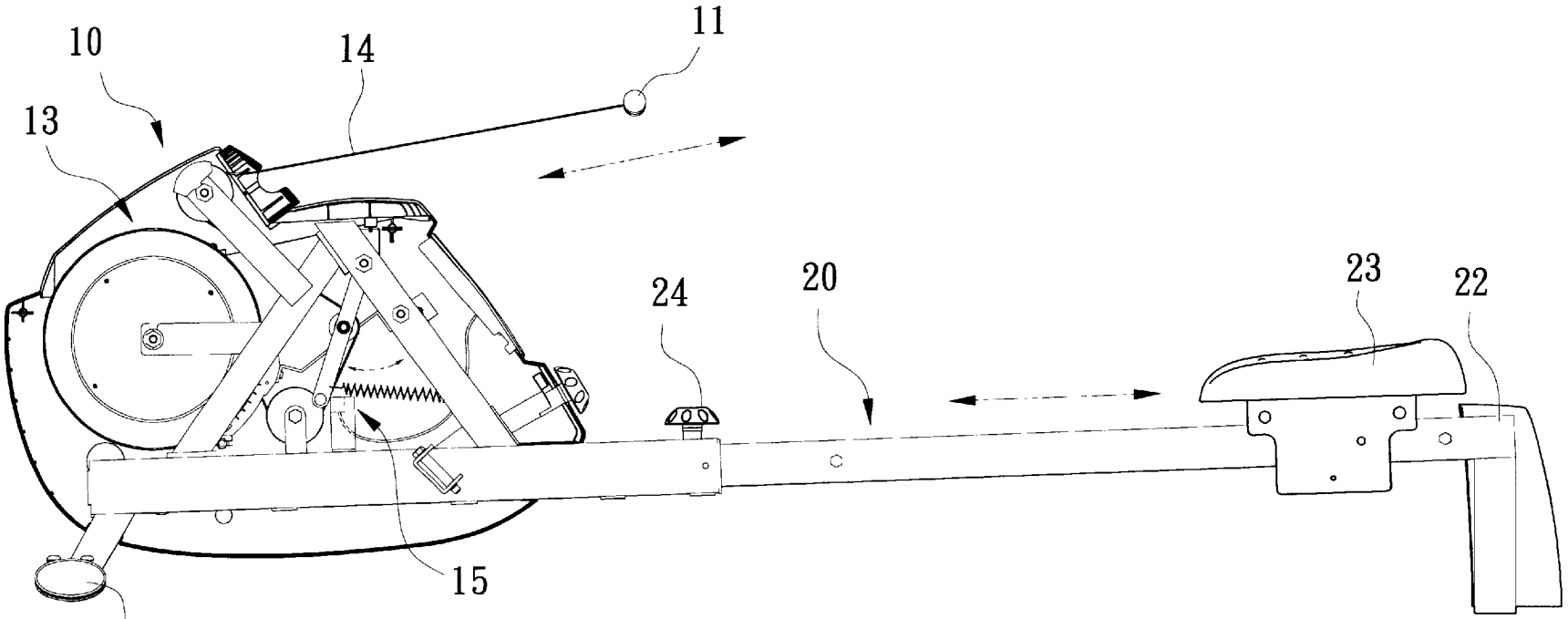

Referring to FIGS. 4*a*, 4*b*, when in use, the supporting rods 21 on the base skeleton 20 are suitably extended and contracted in pursuance of the scope of exercising required and the size of a spot given, then the feet of a user are fixed by using the fastening belt 162 and the heel abutting plate 163 in the pedaling portion 16 (as shown in FIG. 3). Thereafter, the handle 11 is pulled up to make the drawing element 14 to draw the reeling axle 13 in the housing 10; the reeling axle 13 then rewinds to reel off the drawing element 14, so that the handle 11 is restored to its original position; meantime, the seat 23 is moved to and fro between the fixing member 24 and the rear base skeleton stand 22 in pursuance of the adjusted length of the supporting rods 21 on the base skeleton 20. Repeated pulling of the handle 11 can thereby achieve the effect of exercising with the exercising apparatus as a rowboat of the present invention. By transmission the state of using by the sensor 15 provided in the housing 10 to the display device 12 provided outside of the housing 10, convenience of operation can be provided.

Figure 5:
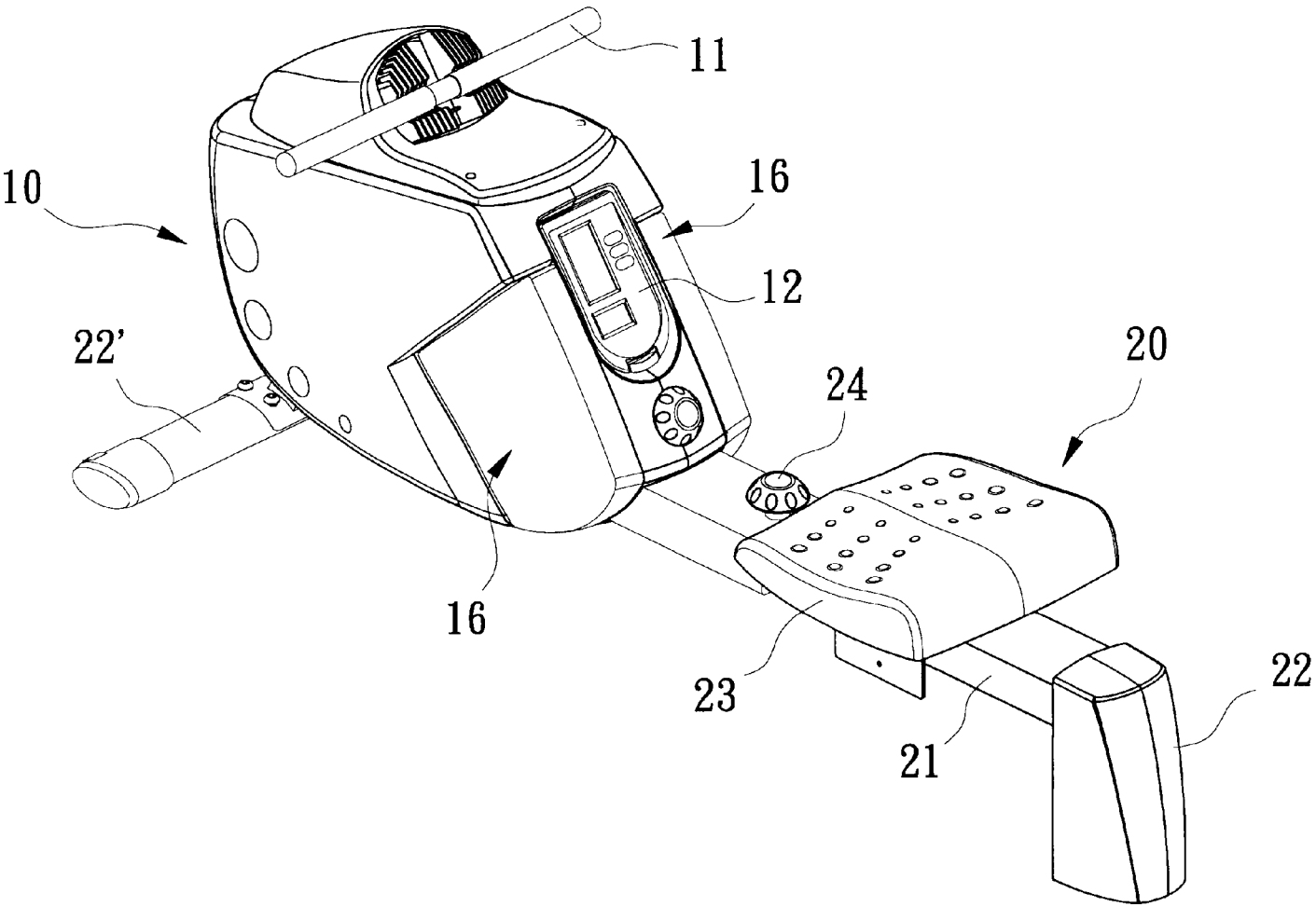
FIG. 5 is a perspective view showing the folded pedaling portion and a folded base skeleton of the exercising apparatus of the present invention after use.

After use, (as shown in FIG. 5), the length of the supporting rods 21 on the base skeleton 20 is contracted to the minimum, and the connecting piece 165 for connecting the pedaling portion 16 with the housing 10 allows the pedaling portion 16 to be folded to the two lateral sides of the housing 10 for convenience of storage and saving space.

The present invention thereby has the following advantages:

1. The base skeleton of the exercising apparatus as a rowboat of the present invention can be extended and contracted for adjusting the length of it in pursuance of the requirement of a user, the spot given for use and for convenience of storage and saving space.
2. The seat of the exercising apparatus as a rowboat of the present invention is movable between the fixing member oh supporting rods and a base skeleton stand, thereby it can achieve the best effect of exercising.
3. The pedaling portion and the housing of the exercising apparatus as a rowboat of the present invention are provided therebetween a connecting piece, the pedaling portion can be folded in the bottoms of the two lateral sides of the housing to improve esthetic appearance of the entire modeling and using of space; and the heel abutting plate is designed to be able to move up and down and can support the feet of a user. So that the exercising apparatus as a rowboat of the present invention has a more humanized design.

According to the above disclosed, the present invention can surely achieved the expected objects to have the functioning elements received in a housing, have the pedaling portion folded and the base skeleton extended and contracted for adjustment, it is really practical.

My invention may assume numerous forms and is to be construed as including all modifications and variations falling within the scope of the appended claims.

What is claimed is:

1. A structure of an exercising apparatus as a rowboat comprising:

a housing including internally thereof a drawing element, a reeling axle, and including externally thereof a handle, two pedals provided respectively on the bottoms of the two lateral sides of said housing wherein said two pedals each is comprised of a bottom plate, a side plate and a foldable connecting piece; wherein said foldable connecting pieces are provided at the joints between said two pedals and said housing respectively, said two pedals are adapted to fold to said two lateral sides of said housing; said drawing element is wound with one end thereof on said reeling axle and is connected on the other end thereof with said handle; when said handle is drawn backwards to move, said drawing element is moved to leave said housing and to move said reeling axle, so that part of said drawing element having been reeled in is reeled off said reeling axle; when the drawing force is stopped, said reeling axle reels back automatically to reel back said drawing element to thereby restore said drawing element and said handle to their original positions; and a base skeleton comprised of two supporting rods, a seat and two base skeleton stands; wherein said supporting rods are mutually telescopically connected for being extended and contracted and are connected with two base skeleton stands; said seat is provided between said housing and the rear base skeleton stand, and is moved to and fro by said extendable and contractible supporting rods.

2. The structure of an exercising apparatus as a rowboat as in claim 1, wherein said housing is provided externally thereof with a display device for displaying digital signals.

3. The structure of an exercising apparatus as a rowboat as in claim 1, wherein said housing is provided internally thereof with a sensor to sense the numeral of times that said reeling axle is pulled.

4. The structure of an exercising apparatus as a rowboat as in claim 1, wherein said two pedals each is provided with a fastening belt to fix the feet of a user.

5. The structure of an exercising apparatus as a rowboat as in claim 1, wherein said two pedals each is provided with a heel abutting plate to support the feet of a user.

6. The structure of an exercising apparatus as a rowboat as in claim 5, wherein said heel abutting plate is adapted to moving to be moved back to said two pedals.

7. The structure of an exercising apparatus as a rowboat as in claim 1, wherein said supporting rods are provided with a fixing member and a plurality of fixing holes.

* * * * *